US008480089B2

(12) United States Patent
Heller

(10) Patent No.: US 8,480,089 B2
(45) Date of Patent: Jul. 9, 2013

(54) MULTI-STAGE POKER GAME

(75) Inventor: Steven Jeffrey Heller, Laguna Niguel, CA (US)

(73) Assignee: Peerless Media Ltd., Europort (GI)

( * ) Notice: Subject to any disclaimer, the term of this patent is extended or adjusted under 35 U.S.C. 154(b) by 361 days.

(21) Appl. No.: 12/851,726

(22) Filed: Aug. 6, 2010

(65) Prior Publication Data

US 2012/0032399 A1 Feb. 9, 2012

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS

| | | | | |
|---|---|---|---|---|
| 5,603,502 | A * | 2/1997 | Nakagawa | 273/292 |
| 5,755,621 | A * | 5/1998 | Marks et al. | 463/42 |
| 6,062,980 | A * | 5/2000 | Luciano | 463/20 |
| 6,312,334 | B1 * | 11/2001 | Yoseloff | 463/25 |
| 6,575,467 | B1 * | 6/2003 | Kal | 273/292 |
| 7,419,162 | B2 | 9/2008 | Lancaster et al. | |
| 7,704,144 | B2 | 4/2010 | Abbott | |
| 8,292,626 | B2 * | 10/2012 | Post | 434/219 |
| 2002/0123377 | A1 * | 9/2002 | Shulman | 463/13 |
| 2003/0176211 | A1 | 9/2003 | Sommerville | |
| 2004/0034873 | A1 * | 2/2004 | Zenoni | 725/135 |
| 2005/0208989 | A1 | 9/2005 | Kane et al. | |
| 2005/0215300 | A1 * | 9/2005 | Oliveras | 463/13 |
| 2006/0025221 | A1 * | 2/2006 | Jain et al. | 463/42 |
| 2006/0035696 | A1 | 2/2006 | Walker et al. | |
| 2006/0058083 | A1 | 3/2006 | Crawford, III et al. | |
| 2006/0157934 | A1 | 7/2006 | Yoseloff et al. | |
| 2006/0178185 | A1 * | 8/2006 | Weis | 463/13 |
| 2006/0234796 | A1 | 10/2006 | Nobrega et al. | |
| 2007/0135950 | A1 * | 6/2007 | Oliveras | 700/91 |
| 2007/0265058 | A1 * | 11/2007 | Govender et al. | 463/19 |
| 2008/0067743 | A1 | 3/2008 | Naicker et al. | |
| 2008/0113700 | A1 * | 5/2008 | Czyzewski et al. | 463/11 |
| 2009/0170586 | A1 | 7/2009 | Jonathan et al. | |

FOREIGN PATENT DOCUMENTS

CA 2 448 644 A1 12/2002

OTHER PUBLICATIONS

Game Rules May 2005.*
High Beam Research, Full Tilt Poker Launches Steps Tournaments, PR Newswire Europe, Apr. 16, 2010, 2 pages, website http://www.highbeam.com/doc/1G1-224124258.html.

(Continued)

*Primary Examiner* — Kurt Fernstrom
*Assistant Examiner* — Dolores Collins
(74) *Attorney, Agent, or Firm* — Beem Patent Law Firm

(57) ABSTRACT

A multi-stage poker game or tournament and a method for conducting the same comprising a first stage in which a first plurality of players buy in at a first amount and a second stage in which a second plurality of players buy in at a second, greater amount. The second stage is a continuation of the game, such that non-eliminated players from the first stage may continue playing the game, along with the second plurality of players. The latter group may start the second stage with substantially equal chip counts, but the chip counts for the former group may be unevenly distributed, e.g., in proportion or substantially equal to their chip counts at the end of the first stage. The end of the first stage or beginning of the second stage may be marked by the occurrence of a predetermined trigger, such as a predetermined average chip count being reached or percentage or number of first stage players being eliminated.

20 Claims, 2 Drawing Sheets

OTHER PUBLICATIONS

WSOP 2010, Online Poker at Full Tilt Poker, Steps to the Main Event, News & Promos, 2 pages, website http://www.fulltiltpoker.com/steps-to-the-main-event.

Heartland Poker Tour, The Structure for Heartland Poker Tour Poker Tournament and Poker Events, The HPT Structure, 5 pages, website http://www.hptnews.com/structure.php.

Your Poker Tour, WPT Satellite FAQ, 2 pages, website http://www.yourpokertour.com/wpt_faq.php.

Wikipedia, The Free Encyclopedia, Satellite tournament, Nov. 17, 2009, 1 page, website http://en.wikipedia.org/wiki/Satellite_tournament.

Pokerstars.com, Poker Tournament Types—PokerStars Structured Tournaments#satellites, 6 pages, website http://www.pokerstars.com/poker/tournaments/types/#satellites.

Fouracepoker.com, Poker Tournaments Blog. Events, strategies and news. (2), Copyright 2008, 9 pages, website http://www.fouracepoker.com/page/2.

Poker for Free, Satellite Qualifier Strategy, Giorgio, Netherlands, Sep. 10, 2008, 2 pages, website http://www.pokerforfree.org/en/poker-articles/77/satellite-qualifier-strategy/.

High Beam Research, World Poker Tour Joins Forces with Casinos Nationwide to Develop New WPT Satellite Events, Business Wire, Dec. 10, 2003, 3 pages, website http://www.highbeam.com/doc/1G1-111091058.html.

High Beam Research, High Stakes on the High Seas; World's Largest Limit Texas Hold 'Em Poker Tournament, Business Wire, Mar. 22, 2004, 3 pages, website http://www.highbeam.com/doc/1G1-114481282.html.

International Searching Authority (ISA/US); PCT International Search Report for international application PCT/US2010/0447858; date of mailing Oct. 6, 2010; 2 pages.

* cited by examiner

MULTI-STAGE POKER GAME

BACKGROUND OF THE INVENTION

1. Field of the Invention

The present invention is directed to a game such as poker, and may include a method for conducting a poker tournament.

2. Description of the Related Art

Poker games or tournaments have been growing in popularity in recent years, particularly due to the WORLD POKER TOUR and its increasing winnings and through the use of online gaming software such as PARTYPOKER. Because of this, many amateur players have been drawn into poker for both diversion and the chance at winning large jackpots. While these venues have made poker more accessible to the novice player, the increased popularity comes at a cost to more experienced players.

Poker may be seen as a game of skill, where experienced players may bet based on both the cards that are played and on their opponents' betting practices, trying to distinguish when an opponent has a strong hand from when the opponent is bluffing. In contrast, more novice players may disregard these tools and bet solely based on their cards and also may bet hoping that they may "catch a break" and achieve a winning hand, even if they do not recognize that the odds are against them. In these cases, the novice player often may lose out to the more experienced player. At other times, however, the novice player may defy the odds and win a large pot at a late stage of a hand, causing the more experienced player to suffer a loss.

Despite this frustration, more experienced players still want to play in the tournament because of the possibility of ultimately profiting. However, they would prefer to minimize the risk that they may be eliminated or have their chip stack substantially reduced due to a more novice player catching a lucky break.

In addition, a player's skill level and his or her bankroll may not be correlated directly. For example, many experienced players may have a skill level that is advantageous in world-class or high-stakes tournaments, but they may not be able to afford the buy-ins that accompany those tournaments.

What is needed is a game that overcomes the drawbacks described above.

BRIEF SUMMARY OF THE INVENTION

In one aspect, a multi-stage poker game may comprise a first stage in which a first plurality of players buy in at a first amount, and a second stage in which a second plurality of players buy in at a second, greater amount, wherein the second stage is triggered when a predetermined number of the first plurality of players are eliminated and wherein the second stage is a continuation of said first stage. The buy-in value for the second stage may be substantially equal or proportional to the average chip count for the non-eliminated players.

After the first stage, a non-eliminated player may begin the second stage with a chip count substantially equal to that player's chip count at the second stage trigger. In addition, players eliminated during the first stage may be allowed to re-buy into the game at the second stage trigger, preferably for the second stage buy-in value. Conversely, non-eliminated players that reach the second stage trigger may be able to increase their chip counts at the trigger, e.g., also by paying an amount equal to the second stage buy-in.

In another aspect, a multi-stage poker tournament method may comprise the steps of receiving buy-ins at a first level from a first plurality of players for a first stage of poker games, conducting a poker tournament among the first plurality of players until a predetermined trigger occurs; and receiving buy-ins at a second level from a second plurality of players for a second stage of poker games. In this method, the non-eliminated players from the first stage each have their own chip counts when the trigger occurs, and they may continue the tournament at the second stage with at least those respective chip counts, which may be more or less than what the second plurality of players may start the second stage with. The method also may include continuing the poker tournament with the competitors comprising the groups of the non-eliminated players from the first stage and the second plurality of players. Further, the method may include the step of calculating an average chip count among the non-eliminated players when the trigger occurs, wherein the buy-in for the second level is substantially equal to the average chip count.

The trigger may occur when one or more criteria take place. For example, the trigger may comprise reaching at least one of: a predetermined number of non-eliminated players, a predetermined percentage of non-eliminated players, a predetermined average chip count, a predetermined high player chip count, a predetermined blind level, and a predetermined time elapse. Alternatively, the trigger may not be predetermined, but rather one or both of the trigger identity/criterion and trigger cutoff value may be determined or modified dynamically as the game progresses. In order to maximize the number of players seated when the second stage begins, the method also may include notifying the second plurality of players that the trigger is approaching.

The tournament may include one or more side jackpots, such as a bad beat jackpot. As such, the method also may include the steps of determining a raked hand minimum pot value, collecting a portion of each raked hand having a pot greater than or equal to the minimum pot value, and allocating at least some of that collected portion to a side jackpot.

The method may be carried out "in real life," such as at a casino, with physical tables, cards, chips, etc. Additionally or alternatively, the method may be operable on one or more computers, such as a plurality of computers connected via an internet connection with each computer running a resident copy of substantially similar software or remotely running a web-based software.

These and other features and advantages are evident from the following description of the present invention, with reference to the accompanying drawings.

DETAILED DESCRIPTION

Figure 1A:
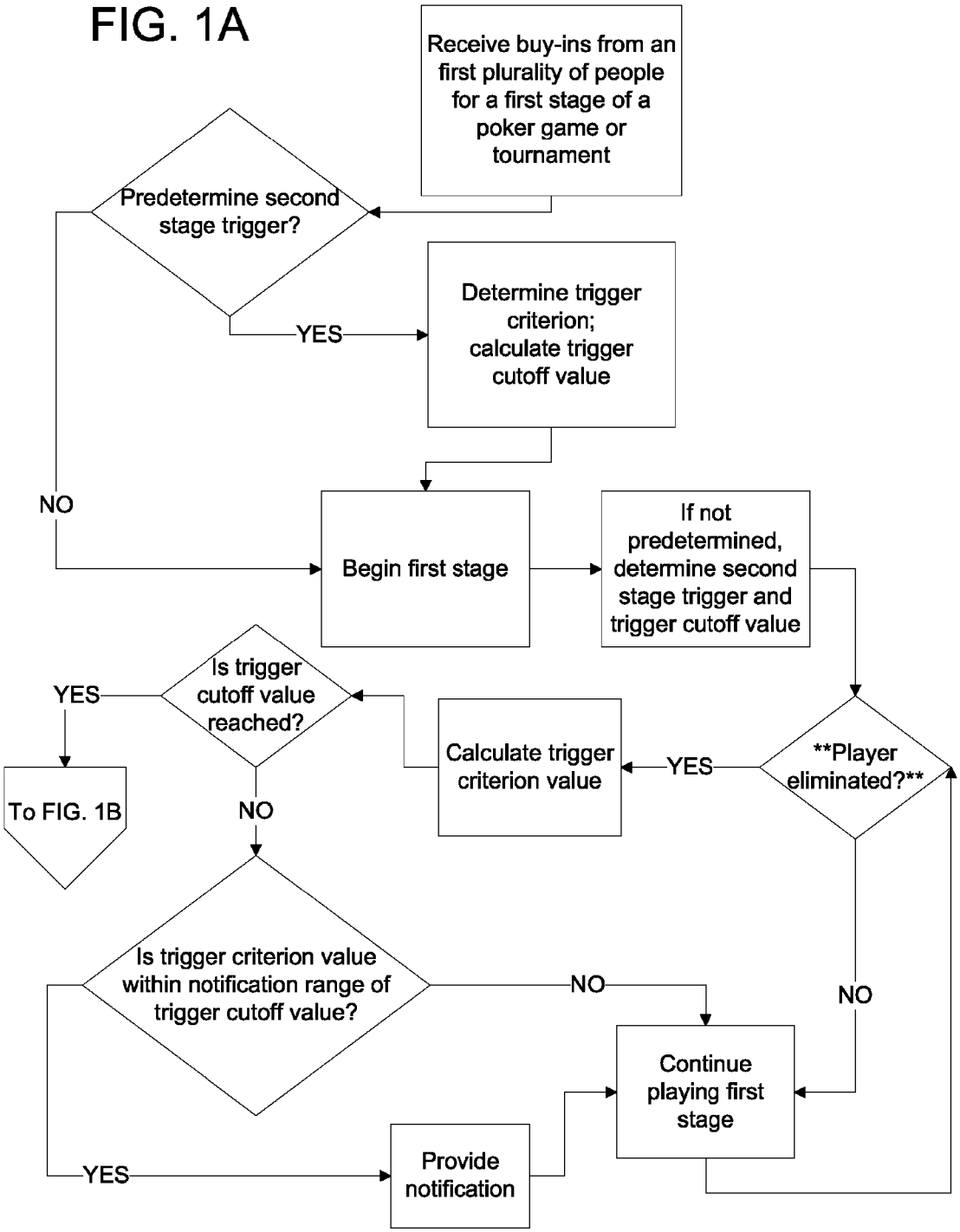
FIGS. 1A and 1B are a process flow-chart of one embodiment of a method for playing a multi-stage poker game or tournament.

A multi-stage poker game or tournament including a plurality of stages with differing buy-in amounts. In one embodiment, the game may include a first stage in which a first plurality of players may buy in at a first amount and a second stage in which a second plurality of players buy in at a second, different amount, which may be a greater amount.

In addition to the rules or variations described herein, the poker game may generally follow the accepted rules of any other type of poker. For example, each hand may be played according to the rules of Texas Hold 'Em, Omaha, 5 card stud, 7 card stud, Draw, etc. The first stage may progress according to these rules. For example, if Texas Hold 'Em is played, for each hand, one player may be a big blind and another may be a small blind. Each player seated at the table may receive two hole cards dealt face down. Three community cards may be dealt face up, followed by a single turn card and then a single river card. In addition, there may be a round of betting before the community cards are dealt, after they are dealt, and after the turn and river. At each stage, players have the opportunity to bet, to check, or to fold. After final bets are made, all remaining players may show their cards in order (unless they fold), moving from the left of the dealer, and the player or players with the strongest hand win the pot. In no-limit versions, players may go "all-in" and bet all of their chips. Players that win these hands have the opportunity to increase their chip counts significantly, but players that lose these hands may be eliminated.

The second stage may be a continuation of the first stage. For example, although the players may be reseated, blind levels may be altered, etc., the non-eliminated players from the first stage may start the second stage with substantially the same chip counts or relative chip counts as they had when the second stage was triggered. Even if the non-eliminated players are permitted to alter their chip counts between the first and second stages, e.g., by paying a second stage buy-in, a key feature of the game is that at least a portion of the players playing the second stage will begin that stage with uneven or unequal chip counts. In addition, as opposed to satellite-style tournaments, the chip count leader or leaders at the end of the first stage preferably receive no additional bonus or payout at the end of that stage.

The second stage may start when a triggering event happens. For instance, the second stage may be triggered once a predetermined number of the first plurality of players have been eliminated. Another way to express this trigger may be to refer to it in terms of the average per-remaining-player chip count. At the start of the first stage, the total number of available chips may be calculated as the number of first-stage players multiplied by the starting per-player chip count. As players are eliminated, this total remains substantially the same, but the average per-player chip count will increase because the total is distributed among fewer players. In this case, the second stage may be triggered when the average chip count reaches a predetermined value.

The game may include bad beat jackpots or other side pots that are funded by taking a portion of each raked hand (or each hand that is raked above a certain, predetermined amount). These side pot rakes may decrease the total value of chips available, thereby decreasing the average chip count. However, if a bad beat or other jackpot is won, at least a portion of those chips may be returned to the field of play, increasing the chip average as compared to the hand prior to the jackpot being won. Because of these dynamically changing average chip counts, a different second stage trigger than the average chip count may be employed when bad beat or other jackpots are included in the game. Alternatively, the game may still use the average chip count as a trigger and may select a predetermined value regardless of what may happen with the side jackpots, or it may adjust the required average chip count trigger value dynamically, i.e., moving the value down as more chips fund the jackpot and back up in the event that the jackpot is won.

In another embodiment, the second stage may be triggered when one of the first stage players reaches a predetermined chip count. Alternatively, the second stage trigger may be the passage of a predetermined amount of time or when blind levels reach a predetermined level. In the latter case, blind levels may increase at known intervals so that potential new second stage players may be able to predict with sufficient certainty when the second stage may begin. In the former case, blind level increases may be accelerated or slowed based on the number of remaining first stage players so that the blind levels may be at or near predetermined levels when the desired amount of time has elapsed. Other stage change triggers may be possible and are considered within the scope of the game.

The criterion/criteria for the second stage trigger preferably is/are predetermined. For example, house rules may state that the second stage begins when a certain percentage of first stage players are eliminated. This percentage may be between about 50% and about 99%, preferably between about 70% and about 90%, and in one embodiment, about 80%, although the predetermined percentage also may fall outside these ranges.

One advantage of making the second stage trigger a predetermined event is that it may provide notice to the players waiting to join at the second stage as to when that may occur. Just as having a lower buy-in amount for the first stage may be attractive to players with a lower price or value point, giving them an opportunity to enter into a higher-stakes or more world-class tournament for less than the normal buy-in value, having a higher buy-in amount may be attractive to other players in that it may serve as a deterrent to less skilled players. Also, in one embodiment, the buy-in for the second stage may be generally equal to the normal buy-in amount for a standard higher-stakes or world-class tournament. Similarly, the ultimate tournament jackpots may be substantially equal to a standard higher-stakes or world-class tournament or, alternatively, the ultimate tournament jackpots may be even higher because the tournament is able to field a larger number of players.

The more experienced players may wish to wait until many of the less experienced, less skilled players are eliminated before joining the game. In addition to weeding out weaker players, this comes with the benefit of having to play fewer hands, which may help the player minimize fatigue and free up that time for the player to pursue other endeavors, e.g., playing in other tournaments, relaxing, spending time with family, etc. Conversely, the game may be advantageous to the players that start at the first stage inasmuch as players who start playing earlier may get into a groove, whereas the players joining later may come in cold.

Several hours (if not days) or more may elapse from the start of the first stage until the second stage trigger occurs, and the second stage players may not want to miss the start of the second stage, which may result in them not being able to join the game, in having their hands folded and blinds forfeited until they join the game, or in other consequences. To avoid this from happening, the game may include an advance notification of the second stage trigger. In a casino or other real world setting, this may include a display board showing relevant trigger information such as the number of remaining players needed to trigger the second stage and the actual number of remaining players, updated as each player is eliminated. Similarly, the display may show the average chip count required along with the current chip count, which may be adjusted as more players are eliminated, or it may show a timer counting up from the start of the stage or counting down until the end of that stage or the beginning of the next stage.

In an online or other networked gaming environment, the notification may include a window or banner displaying similar information. This window or banner may pop up automatically at a predetermined time or it may be embedded in an already open window. For example, a player may have a window open with one or more other games displayed, and the window may include a banner overlaid with those game tables. The banner may be relatively translucent so that information below it may still be at least partially visible. Alternatively, the banner may be opaque, and the open table portion of the window may be resized to accommodate the banner, so that no information from the open table is obscured to the player.

Players contemplating joining the game at the second stage also may subscribe to receive an alert such as an email, text or SMS message, or other automated notification that the second stage trigger is approaching and/or has been met.

Notifications may be established and delivered according to predetermined criteria. For example, when the trigger criterion is the percentage of eliminated first stage players, a notification may be created and delivered/displayed when the percentage is within about 5 percentage points of the preselected value. Similarly, if the trigger criterion is the passage of a certain amount of time, a notification may be created and delivered/displayed manually or automatically about 10 minutes before that time is reached.

The game may include a temporary break between the second stage trigger and the start of the second stage. This time period may be any length of time, but, e.g., the game may comprise a 30 minute break. The break may serve multiple purposes, such as allowing remaining first stage players to have a chance to relax, regroup, or recover from the first stage. The break also may allow potential new second stage players to show up, buy in, and be seated. These new players may include eliminated first stage players that opt to rebuy. In another embodiment, non-eliminated first stage players may be permitted to pay the second stage buy in fee to increase their existing chip counts. Additionally or alternatively, the non-eliminated first stage players may be able to pay the second stage buy in fee as insurance in the event that they later are eliminated. In that case, the player's chip count may be replenished to the second stage buy-in level, with the player continuing the game from there.

In still another embodiment, first stage players that survive until the second stage trigger may receive a bonus. This bonus may be a predetermined value of chips to each player, regardless of the player's relative chip count as compared to the other surviving players. Alternatively, players may be rewarded for their success in the first round, such that the bonus may be rewarded progressively, with larger bonuses going to the players with the larger chip counts. As compared to satellite tournaments, where the winners of the satellite tables may receive vested compensation, the bonuses described herein may be applied to the players' chip stacks. In other words, here, the player may receive additional chips, but those chips may not be cashed out. Instead, they only may be used to continue playing the game.

Because the first stage ends before a winner has been determined, a plurality of first stage players will remain with chips when the triggering event is reached. These players likely will have varying chip counts, some of which may be higher than the starting chip count for players starting at the second stage and some of which may be lower.

In one embodiment, each stage may be open to any number of players. Alternatively, one or more of the stages may include a cap on the number of players.

Figure 1B:
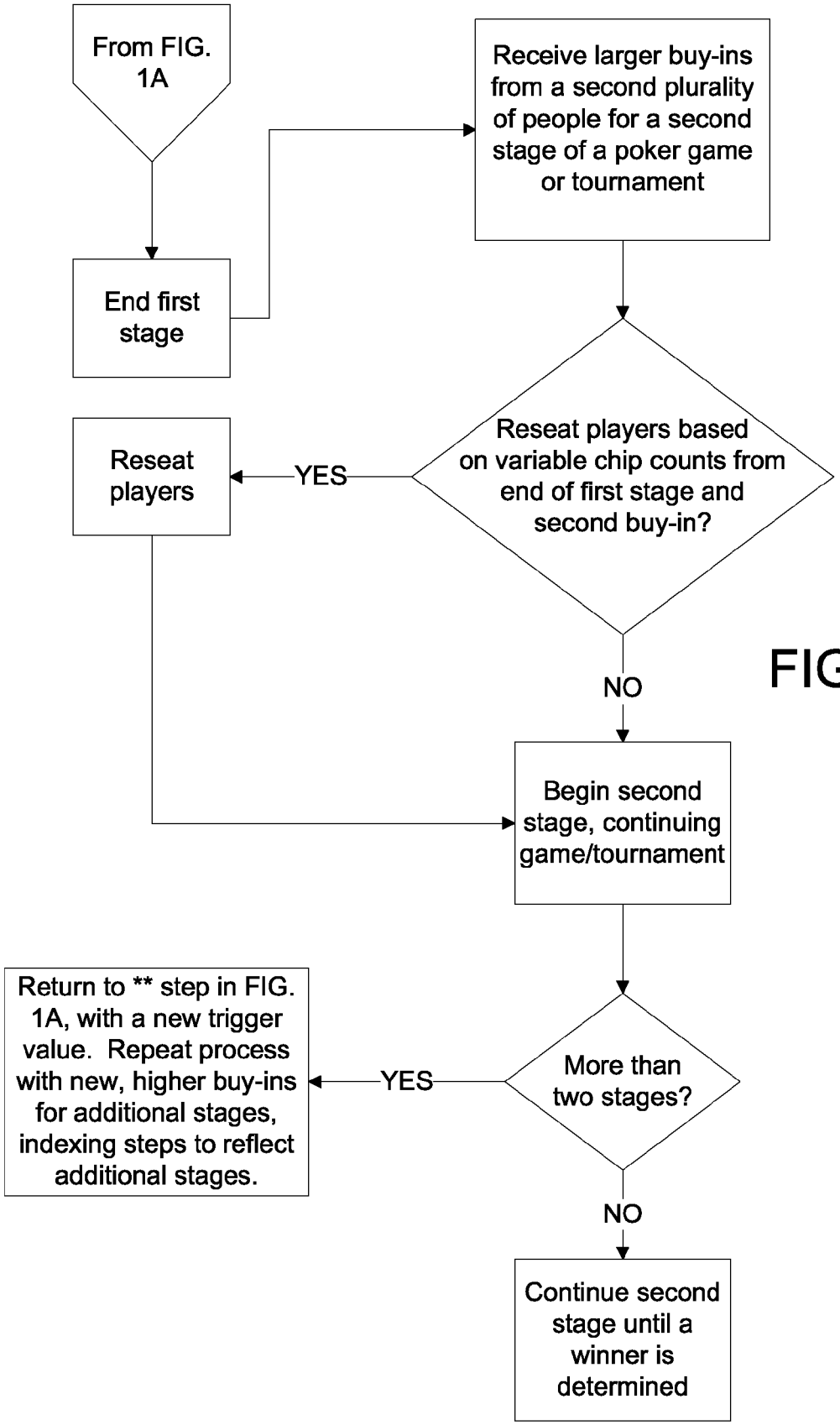

Turning to FIGS. 1A and 1B, a flowchart describing a method of conducting one embodiment of the game or tournament is shown. In this embodiment, the trigger criterion may depend on the number of players that have been eliminated. For example, the criterion may be the number of eliminated or remaining players, the percentage of eliminated players, the average per-remaining-player chip count, etc.

As seen in FIG. 1A, the method may commence with receiving buy-ins from the first group of people that will play the first stage. Preferably, the trigger is predetermined so that these players and potential later players know what the trigger criterion is and what the cutoff value will be before play begins. In either event, the first stage begins and play is carried out according to the predetermined game rules, e.g., house rules for no-limit Texas Hold 'Em.

As play progresses, hands and chips are won and lost and, over time, players are eliminated. If no player is eliminated, play continues. If, however, a player is eliminated in this embodiment, the trigger criterion value is calculated and/or updated and compared with the trigger cutoff value to determine if the trigger cutoff is reached. If it is not reached, play continues, but the trigger criterion value is compared to a (preferably predetermined) notification range to determine its proximity to the trigger cutoff value. If the trigger criterion value is within the notification range of the trigger cutoff value, a notification may be displayed, transmitted, broadcast, etc., to notify remaining first stage players and potential second stage players that the trigger/end of first stage/beginning of second stage are approaching.

Turning to FIG. 1B, if the trigger criterion value meets or exceeds the trigger cutoff value, the first stage ends, with each remaining player retaining his or her own, unequally distributed chip count. A larger buy-in value as compared to the first stage may be set for the second stage, and these larger buy-ins may be received from a second plurality of people. Once a time for buy-ins closes, the remaining non-eliminated first plurality of players and the second plurality of players may be reseated, e.g., accounting for the variable chip counts of the non-eliminated players. (Players also may be reseated periodically throughout both the first and second stages, e.g., to account for changing numbers of players at each of the various tournament tables.) The second stage commences and the tournament progresses like a standard poker tournament. If more than two stages are employed, the process preferably repeats, e.g., having a second stage trigger criterion and cutoff value that need to be reached, reaching that cutoff value and stopping the second stage, having an even greater third stage buy-in for a third plurality of people, commencing the third stage, etc. Once the last stage commences, the tournament progresses much like a normal tournament, with players eliminated until a winner is determined.

The game also may be played electronically, e.g., on a networked gaming system such as a plurality of computers, including personal computers, mobile devices, etc., connected via the Internet and running similar software such as PARTYPOKER. While the display for the first and second stages may be different to visually distinguish each stage to a player, because the second stage is a continuation of the first stage, the screen display for each stage preferably may be substantially similar. For example, the table may seat substantially the same number of players, the deck and card displays may be substantially the same, the same colors may be used for the same chip values, etc. The game window may include a notification of the current stage being played, e.g., the game table may include text saying "First Stage" or "Second Stage," the window header may list the game stage, etc.

In still another embodiment, the game may include a combination of both "brick and mortar" tables such as those in one or more casinos and electronic or computerized tables. The characteristics described herein with respect to games played solely on "brick and mortar" tables may apply similarly to the "brick and mortar" tables of this hybrid variety, and the characteristics described with respect to computer based gaming similarly may apply to the electronic or computerized tables of the hybrid game.

With respect to the "brick and mortar" tables and the hybrid "brick and mortar"/electronic embodiments, the game may take advantage of potential space limitations. For example, a physical space that may not be large enough to accommodate the total number of players in both the first and second stages at one time instead may be configured to accommodate the number of players in the first stage (which may be smaller than the combined number of tables necessary) and then reconfigured to accommodate the second stage (which also may be smaller than the combined number of tables necessary).

The game may utilize a system including a plurality of computers each having at least one display and input tools such as a keyboard, mouse, etc. Each computer may be in communication with a central computer operatively connected to a database. The central computer may include software for running the game, e.g., calling a random number generator to determine what cards will be dealt to each player at each table, keeping track of player hands, wagers, winnings, losses, and monitoring and updating the status of the second stage trigger. With respect to "brick and mortar" tables, although play may be effectuated with traditional cards and chips, these system elements also may be incorporated in order to keep track of and record historical information relating to the game.

Although the game as described above includes a first stage and second stage, additional stages are possible. These stages may have buy-ins substantially equal to an earlier buy-in value. Preferably, however, the buy-in amounts may increase progressively in later stages to prevent players from "waiting until the last minute" to join. When the game includes more than two stages, the same events described herein as relating to the first and second stages also may apply to the various "n" and "n+1" stages.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A method for conducting a multi-stage poker game, comprising:

conducting a first stage in which a first plurality of players buy in at a first amount;

conducting a second stage in which a second plurality of players buy in at a second, greater amount and in which at least some players within said second plurality of players are not part of said first plurality of players;

wherein said second stage is triggered when a predetermined number of said first plurality of players are eliminated;

wherein the game is conducted electronically; and wherein activity in the first stage is transmitted to the first plurality of players on one or more computers and activity in the second stage is transmitted to the second plurality of players on one or more computers.

2. A method according to claim 1, wherein said second stage is a continuation of said first stage.

3. A method according to claim 1, wherein an average chip count at the second stage trigger comprises a total number of first stage available chips divided by the number of non-eliminated first plurality of players; and wherein a buy-in value for said second stage is substantially equal to said average chip count.

4. A method according to claim 1, wherein a non-eliminated player from said first plurality of players begins said second stage with a chip count substantially equal to the non-eliminated player's chip count at the second stage trigger.

5. A method according to claim 1, further comprising an advance notification of said second stage prior to said second stage trigger.

6. method according to claim 1, wherein said predetermined number of eliminated first plurality of players is between about 50% and about 99%.

7. A method according to claim 1, wherein said predetermined number of eliminated first plurality of players is between about 70% and about 90%.

8. A method according to claim 1, wherein said predetermined number of eliminated first plurality of players is about 80%.

9. A method according to claim 1, wherein said eliminated first plurality of players are allowed to re-buy into said game at said second stage trigger.

10. A method according to claim 1, wherein non-eliminated players from said first plurality of players are allowed to increase their chip counts at said second stage trigger by paying an amount equal to said second stage buy-in.

11. A multi-stage poker tournament method, comprising:

executing, by a processor, a computer program directing one or more computers to perform the steps of:

receiving buy-ins at a first level from a first plurality of players for a first stage of poker games;

conducting a poker tournament among said first plurality of players until a predetermined trigger occurs; and receiving buy-ins at a second level from a second plurality of players for a second stage of poker games;

wherein at least some players within said second plurality of players are not part of said first plurality of players;

wherein non-eliminated players from said first stage each have a chip count when said trigger occurs and continue said tournament at said second stage with at least said chip count.

12. A multi-stage poker tournament method according to claim 11, further comprising:

continuing said poker tournament among said non-eliminated players from said first stage and said second plurality of players.

13. A multi-stage poker tournament method according to claim 11, wherein said second level is greater than said first level.

14. A multi-stage poker tournament method according to claim 11, further comprising:

calculating an average chip count among said non-eliminated players when said trigger occurs, wherein said buy-in for said second level is substantially equal to said average chip count.

15. A multi-stage poker tournament method according to claim 11, wherein said trigger comprises reaching at least one of: a predetermined number of non-eliminated players, a predetermined percentage of non-eliminated players, a predetermined average chip count, a predetermined high player chip count, a predetermined blind level, and a predetermined time elapse.

16. A multi-stage poker tournament method according to claim 11, further comprising:

notifying said second plurality of players that said trigger is approaching.

17. A multi-stage poker tournament method according to claim 11, further comprising:

accepting re-buys from eliminated players from said first stage prior to continuance of said tournament at said second stage.

18. A multi-stage poker tournament method according to claim 11, further comprising:

awarding a bonus to non-eliminated players from said first stage prior to continuance of said tournament at said second stage.

19. A multi-stage poker tournament method according to claim 11, further comprising:

determining a raked hand minimum pot value;

collecting a portion of each raked hand having a pot greater than or equal to said minimum pot value; and allocating at least some of said portion to a side jackpot.

20. A multi-stage poker tournament method, comprising:

receiving buy-ins at a first level from a first plurality of players for a first stage of poker games played at a plurality of physical game tables;

conducting a poker tournament among said first plurality of players using a plurality of physical game cards until a predetermined trigger occurs; and receiving buy-ins at a second level from a second plurality of players for a second stage of poker games played at a plurality of physical game tables;

wherein at least some players within said second plurality of players are not part of said first plurality of players;

wherein non-eliminated players from said first stage each have a chip count when said trigger occurs and continue said tournament at said second stage with at least said chip count.

* * * * *